United States Patent [19]

Schaper

[11] 4,273,242

[45] Jun. 16, 1981

[54] STABILIZING DEVICE

[75] Inventor: Donald W. Schaper, Alliance, Ohio

[73] Assignee: Marathon LeTourneau Company, Longview, Tex.

[21] Appl. No.: 40,330

[22] Filed: May 18, 1979

[51] Int. Cl.[3] ..... B66C 13/06

[52] U.S. Cl. ..... 212/147

[58] Field of Search ..... 212/14, 15, 10, 11, 212/12, 13, 125, 126, 127, 128, 129, 218, 219, 220; 254/144, 192; 294/815 F, 78 A

[56] References Cited

U.S. PATENT DOCUMENTS

| | | | |
|---|---|---|---|
| 3,396,858 | 8/1968 | Baker et al. | 212/14 |
| 3,653,518 | 4/1972 | Polen | 212/125 |

FOREIGN PATENT DOCUMENTS

| | | | |
|---|---|---|---|
| 2019096 | 10/1970 | Fed. Rep. of Germany | 212/14 |

*Primary Examiner*—James B. Marbert

*Attorney, Agent, or Firm*—Vinson & Elkins

[57] ABSTRACT

An apparatus is disclosed for stabilizing against sway a body suspended by cables from an overhead support. The apparatus includes first and second opposed rigid stabilizing members pivotally connected at their lower ends to the body, guides carried by the overhead support for guiding the upper ends of the stabilizing members for pivotal and longitudinal movement relative to the overhead support and force transmission means interconnecting the stabilizing members for transmitting forces therebetween so as to generate substantially equal and opposed forces for stabilizing the body against sway, without interfering with the raising and lowering of the body by the suspension cables. This abstract is not to be construed in any way to define or limit the invention set forth below.

19 Claims, 8 Drawing Figures

STABILIZING DEVICE

BACKGROUND OF THE INVENTION

Many types of hoisting devices, such as gantry cranes, bridge cranes, overhead gantries and the like, employ large horizontal beams supported over the lifting area. The beams are normally movable longitudinally on fixed rails, tracks or on guidable wheels which permit the gantries to be moved along the open ground. The beams are elevated above the lifting area by raised tracks or rails, or by the provision of elongated supports, or legs, at each end of the gantry structures. The hoisting operation is accomplished by a winch or similar device which raises and lowers cables attached to a lifting frame, hook, or other load-engaging means from which the load is suspended. Usually, the load-carrying cables are attached to one or more trolleys which run transversely along the gantry beam. This arrangement permits the load to be moved vertically by the hoisting apparatus, transversely by the trolleys, and longitudinally, by moving the beam.

Because the load is suspended by flexible cables, longitudinal or transverse movement of the hoisting apparatus tends to cause sway of the load being carried, which sway is considered undesirable. This is particularly true where the gantry crane is being used to handle large cargo containers or truck trailers in dockyards or railyards. The loads in such instances require accurate placement and any sway induced during movement of the load must be permitted to decay before final placement of the container, etc. This obviously is time consuming and expensive.

In the past, efforts have been made to reduce the sway of loads suspended from such hoisting apparatus. Such efforts have included reeving arrangements in which the hoisting cables diverge outwardly and upwardly and thus tend to resist sway. See, for example, U.S. Pat. Nos. 3,825,128 and 3,086,661. Other patents have suggested the use of a separate stabilizing system (Tacks, et al, U.S. Pat. No. 3,746,182) and the use of tag lines (Crittenden, U.S. Pat. No. 3,532,324). Another solution has been to provide a horizontal stabilizing beam which is guided on the gantry legs and raised and lowered along with the load to provide a stabilizing support. Such structures are shown in U.S. Pat. Nos. 3,161,309; 3,176,853; and 3,251,496.

Co-pending patent application Ser. No. 731,585 of Harris, entitled "Anti-Sway Cable System for Straddle Hoists" and assigned to the assignee of the present invention, discloses an improved anti-sway system employing variable brake means incorporated into the reeving system of the hoisting cables. This system is entirely satisfactory for preventing transverse sway (generally parallel to the longitudinal axis of the horizontal gantry beam), but is less desirable for preventing longitudinal sway (generally perpendicular to the longitudinal axis of the lifting beam) in most movable gantry cranes. Such longitudinal sway may, however, be simply and effectively prevented by utilization of the apparatus of the present invention.

SUMMARY

The present invention provides an improved stabilizing device which finds its preferred use in stabilizing loads carried by movable hoisting apparatus.

The stabilizing device employs opposed stabilizing members which are pivotally attached to the load, or to a hoisting frame or other body which in turn carries the load, and have their upper ends guided with respect to the overhead horizontal beam. Force transmission means interconnect the stabilizing members in such a way that a force tending to cause longitudinal sway of the load generates substantially equal and opposed forces to resist sway.

It is the primary object of the present invention to provide an improved stabilizing apparatus which may be used to stabilize bodies suspended from overhead supports.

Another object is to provide such a stabilizing apparatus which is idler in nature and requires no independent power supply for its operation.

Another object is to provide such stabilizing apparatus which does not interfere with the normal vertical, transverse or longitudinal movement of the suspended body or of the suspension apparatus.

A still further object is to provide such a stabilizing apparatus which may be used in connection with large movable gantry cranes for stabilizing suspended bodies and loads against sway in a direction generally perpendicular to the longitudinal axis of the gantry beam.

BRIEF DESCRIPTION OF THE DRAWINGS

These and other objects and advantages of the invention will be apparent from the drawings, specification and claims. In the accompanying drawings, in which like numerals indicate like parts:

DESCRIPTION OF THE PREFERRED EMBODIMENT

Figure 1:
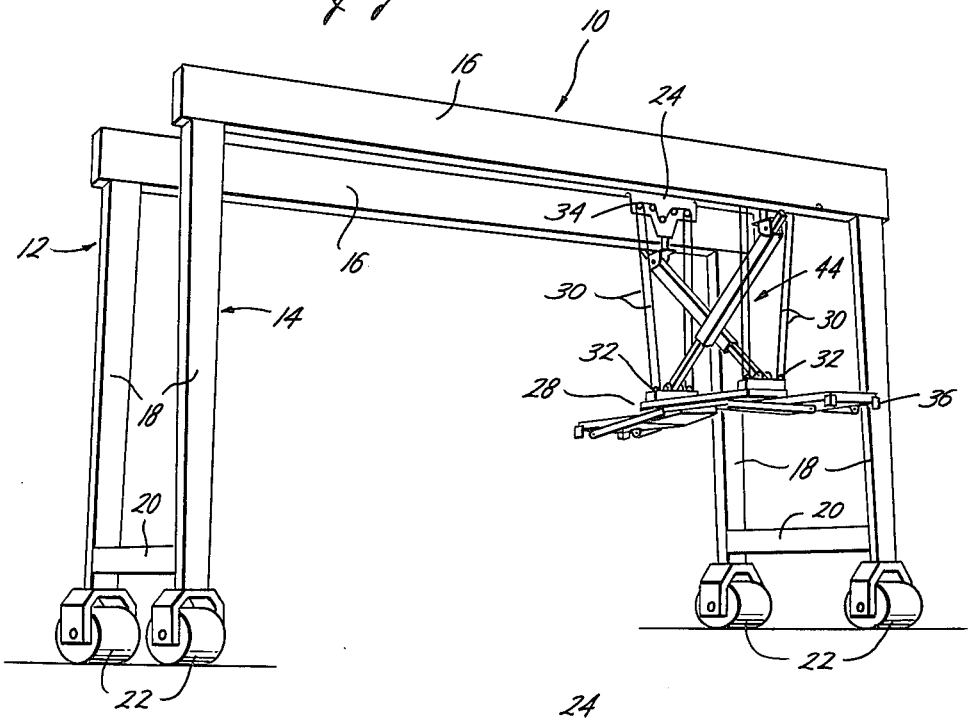
FIG. 1 is a perspective view of a large movable hoisting apparatus employing the stabilizing device of the present invention.

Referring to FIG. 1, there is illustrated a movable hoisting apparatus or gantry crane 10 which includes a pair of elevated gantry frames 12 and 14 each of which includes an elongated generally horizontal overhead support member or beam 16 supported by a pair of generally vertical legs 18 joined at their lower ends by horizontal frame members 20 to provide a unitary structure for the gantry 10. The frame members 20 are supported on guidable movable wheels 22 so that the entire gantry apparatus may move along the ground in any desired direction. Self-contained power means (not shown) such as a diesel engine, are provided for powering the wheels 22 for movement, as well as for operating hoisting winches and for other power requirements for the gantry crane.

A movable trolley 24 is provided on each of the overhead beams 16. The trolleys 24 are mounted on rollers 26, permitting the trolleys to move transversely across the horizontal beams 16.

The trolleys 24 may be powered for transverse horizontal movement in any desired manner, and are conventionally moved by means of flexible cables extending generally parallel to the beams 16 and moved by powered winches carried by the gantry 10 or by the trolleys 24. A load carrying body or lifting frame 28 is suspended from the trolleys 24 by means of flexible cables 30 reeved around sheaves 32 on the load carrying frame 28 and a plurality of sheaves 34 provided on the trolleys 24. Means such as powered winches are provided on the trolleys 24 for lengthening or shortening the flexible cables 30 to thereby raise and lower the frame 28.

The frame 28, and any load carried by it, is therefore adjustable vertically and transversely within the gantry frame structure and the entire gantry frame structure is movable as desired on the wheels 22. Additionally, the lifting frame 28 may be disposed at desired angular positions, vertically and horizontally, by suitable lengthening or shortening of the suspension cables 30, and by transverse misalignment of the two trolleys 24. Such angular positioning of the lifting frame 28 is desirable for pick-up and placement of loads, which often are not disposed at 90° relationships to the overhead beams 16.

Figure 2:
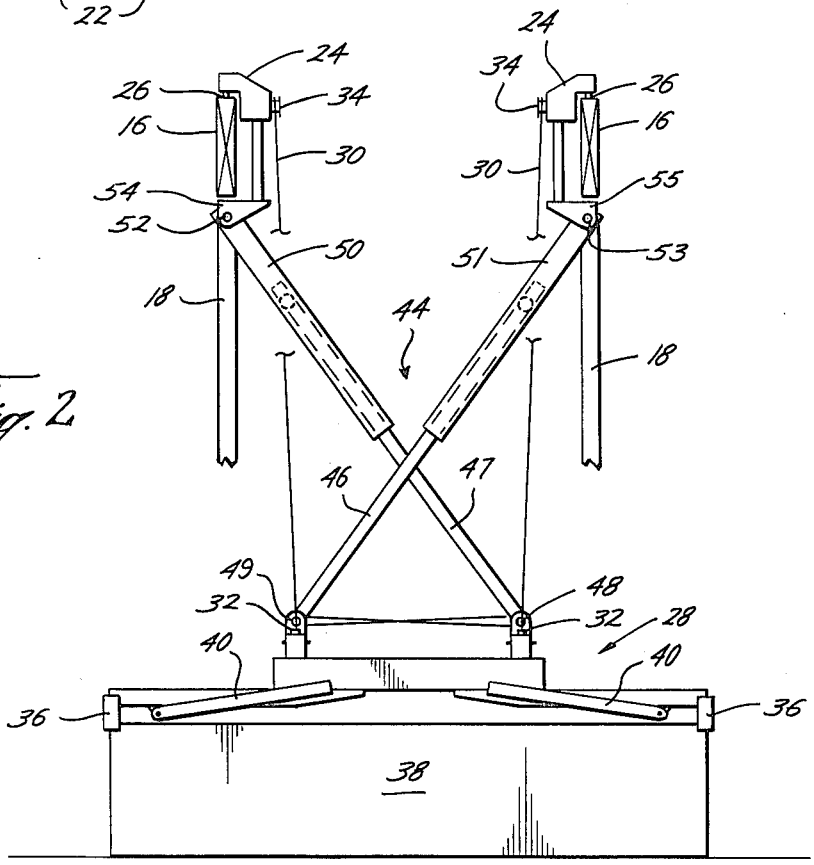
FIG. 2 is an enlarged detail view in side elevation of the stabilizing apparatus of FIG. 1, and including additionally, a cargo container being carried by the hoisting apparatus.
Figure 3:
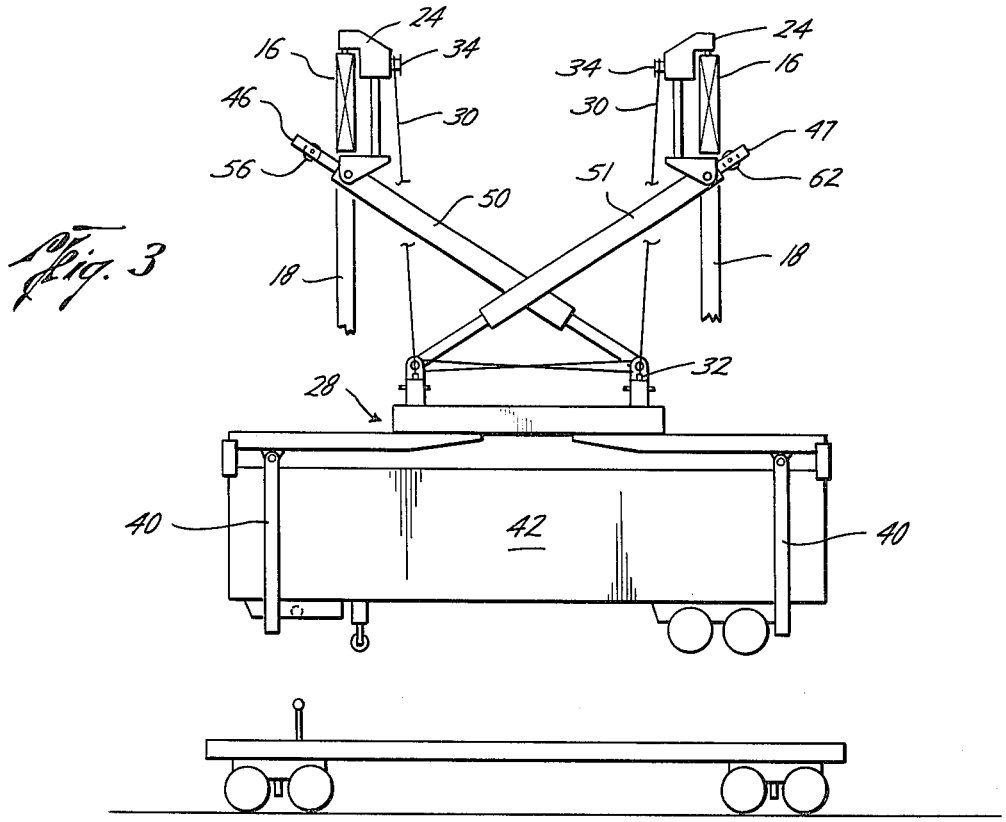
FIG. 3 is a view similar to FIG. 2 showing the stabilizing apparatus with the cargo at a different vertical position and indicating the cargo being carried as a truck trailer suspended over a railway flatbed car onto which it is being placed.

As shown in somewhat greater detail in FIGS. 2 and 3, the lifting frame 28 is provided with load engaging means including four corner latches 36 adapted to engage latch receiving recesses (not shown) in the upper surface of the cargo containers 38. The lifting frame 28 may also include four lifting arms 40 adapted for bottom lifting of loads, such as truck trailer bodies 42 (FIG. 3) or cargo containers not provided with the special latch receiving recesses. When not in use, the bottom-lifting load arms 40 are adapted to be swung into an out-of-the-way position as illustrated in FIGS. 1 and 2. The construction and operation of the latches 36 and lifting arms 40 are conventional and are shown, for example, in U.S. Pat. No. 3,558,172.

Since the lifting frame 28, and any load carried by it, are suspended by the flexible cables 30, movement of the frame and load, either transversely across the beams 16 by movement of the trolleys 24, or longitudinally, by moving the entire gantry structure, tends to cause swaying of the frame 28 and its load, due to the inertia which must be overcome before the load will begin to move in a transverse or longitudinal direction. Sway incuding forces may also be exerted by wind, gravity, or other means. Swaying or swinging of the empty frame 28 is undesirable since it makes it more difficult to accurately engage and attach a load; sway of the loaded frame 28 makes it hard to accurately place the cargo at its intended destination.

In co-pending application Ser. No. 731,585, assigned to the assignee of the present invention, is disclosed a method for minimizing sway in a direction generally transverse to the gantry structure, that is, parallel to the longitudinal axis of the horizontal beam 16. This system employs a braking mechanism on the continuously reeved cables 30 and has poured entirely satisfactory for minimizing transverse sway. The apparatus of application Ser. No. 731,585 is not, however, as readily applicable to stabilizing the frame 28 and any load carried by it against longitudinal sway (generally parallel to the longitudinal axis of the rectangular lifting frame 28 and perpendicular to the longitudinal axis of overhead beams 16). Therefore, a separate stabilizing device is useful for that purpose.

The stabilizing device of the present invention includes at least a pair of opposed, rigid, elongate stabilizing members pivotally connected at their lower ends, to the body to be stabilized. The two stabilizing members are inclined at opposed acute angles with respect to the body being stabilized and have their upper ends guided with respect to the overhead support from which the body is suspended. The guide means permit both pivotal and longitudinal movement of the upper ends of the stabilizing members. Interconnecting the two stabilizing members are force transmission means which act to transmit a force applied to the load in a direction tending to cause sway into substantially equal and opposed forces which, in effect, cancel each other out and thereby prevent or minimize sway of the load.

While it is generally preferred that the stabilizing members be connected at their lower ends to the suspended body being stabilized, they could, alternatively, be pivotally connected at their upper ends to the overhead support or trolleys, with the guide means being carried by the suspended body. As will be apparent from the following detailed description, such reversal of parts could be made while still accomplishing the objects of the invention.

In the preferred embodiment, as illustrated in FIGS. 1–7, the stabilizing apparatus is indicated generally by the numeral 44. The stabilizing members consist of a pair of opposed rigid elongate rods 46 and 47, each pivotally connected at its lower end by pivots 48 and 49, respectively, to the lifting frame 28. The stabilizing rods have the cross-sectional configuration of an I-beam (FIG. 5) for increased rigidity and have their upper ends guided in the elongated guide members 50 and 51. Guides 50 and 51 each have an elongate open bore of rectangular cross-sectional configuration (FIG. 5) corresponding to the maximum dimensions of the rods 46, 47. The upper ends of the guides 50, 51 are pivotally connected by pivots 52 and 53, respectively, through depending support structures 54 and 55 to the overhead trolleys 24. Thus, the guides 50, 51 and stabilizing rods 46, 47 will move transversely of the overhead beams 16 along with the trolley 24 and lifting frame 28.

Since the rods 46, 47 are free to slide within the guides 50, 51, the upper ends of the stabilizing rods 46, 47 are therefore free to move both longitudinally and pivotally with respect to the overhead support as the lifting frame 28 and any load carried by it are raised or lowered relative to the overhead beams 16 and trolleys 24. Thus, as shown in FIG. 2, with the lifting frame 28 at a relatively low position, the upper ends of the stabilizing rods 46, 47 are well below the overhead beams 16 and within the central bores of the guide members 50, 51. However, when the lifting frame is raised by means of the cables 30 and winches 34, the stabilizing members 46, 47 and guides 50, 51 will pivot into a more acute angular relationship with the horizontal. As the distance between the pivot points 48 and 52 and 49 and 53 is decreased, the upper ends of the stabilizing rods 46 and 47 will move upwardly through the bores of the guides 50, 51 and are free to move past the pivot point 52, 53 and out the upper end of the guides as illustrated in FIG. 3.

The apparatus thus far described is completely idler in nature and offers no substantial restraint to either raising or lowering of the lifting frame 28 or to sway of the frame 28. However, there are provided in connection with the stabilizing rods and guides force transmission means interconnecting the rods and guides so as to stabilize the lifting frame 28 against longitudinal sway while at the same time not interfering with the raising and lowering of the lifting frame 28 relative to the gantry structure. In the preferred embodiment, as illustrated in greater detail in FIGS. 4 through 6, the force transmission means comprise a cable and sheave arrangement including an antifriction sheave 56 disposed near the upper end of the first stabilizing rod 46 and a pair of anti-friction sheaves 58 and 60 disposed at the lower end of the rod 46, cocentrically with the pivot point 48. A corresponding single sheave 62 is disposed near the upper end of the second stabilizing rod 47 and a pair of sheaves 64 and 66 are disposed at its lower end, cocentrically with the pivot 49. A first flexible fastener 68, preferably a wire-rope cable, is fixed at a point 70 within the bore of the first guide 50, the point 70 being below the lowest expected point of travel of the sheave 56. Cable 68 extends upwardly from attachment point 70 and is reeved about the upper sheave 56 from which it extends downwardly parallel to the rod 46 and is reeved about sheave 58 from bottom to top. The cable 68 is then crossed over to the bottom of second stabilizing member 47 and is reeved about the lower sheave 66 from bottom to top. From there it extends upwardly, parallel to the rod 47, and is fastened at a point 72 to the second guide member 51. Again, the fastening point 72 is below the anticipated lowest point of travel of the upper sheave 58 on rod 47.

A second flexible cable 74 is fastened to the second guide member 51 at a point 76 and from there extends upwardly and around the upper sheave 58 on stabilizing rod 47, downwardly and about sheave 64 on the lower end of stabilizing rod 47 from bottom to top. From there it crosses over to the bottom of the first stabilizing member 46 and is reeved about the sheave 60, from the bottom to top. From there it extends upwardly parallel to the rod 46 and is attached to the first guide member 50 at a point 78. While the reeving is illustrated in the preferred embodiment as including two flexible cables 68 and 74, the same reeving could be accomplished using a sigle cable fastened to each of the guide members 50 and 51 at points below the lowest anticipated point of travel of the upper sheaves 56 and 58.

With this reeving arrangement, the lifting frame 28 may be raised and lowered freely relative to the overhead trolleys 24, but can no longer sway freely in a longitudinal direction. When the lifting frame is raised or lowered by the cables 30, the upper end of each of the stabilizing rods 46 and 47 will move upwardly in the corresponding guides 50 and 51 by equal amounts, as the lower ends of the rods 46 and 47 are raised with the lifting frame. The extra length of cables 68 and 74 required between the upper sheaves 56 and 58 and the cable attachment points 70 and 76 as the lifting frame 28 is raied, is automatically supplied by the corresponding upward movement of the sheaves at the lower ends of the stabilizing rods. As the lifting frame is lowered, the reverse occurs, so that the cables always remain essentially taut during either raising or lowering, but do not exert any forces (other than friction and inertia forces) tending to impede the raising or lowering of the lifting frame 28.

However, when the lifting frame sways in a longitudinal direction (to the right or left as viewed in FIG. 4), relative to the fixed overhead support, then the rods 46 and 47 do not move up and down simultaneously in the guides 50 and 51, but rather one must move downwardly with respect to its guide while the other moves upwardly. Stated another way, one of the pivot point pairs 48-52 and 49-53 must move closer together while the other moves further apart. Because of the particular reeving arrangement, this is not possible, with the result that tension is generated in one of the cables 68 or 74, which tension opposes the force tending to generate the sway.

Figure 4:
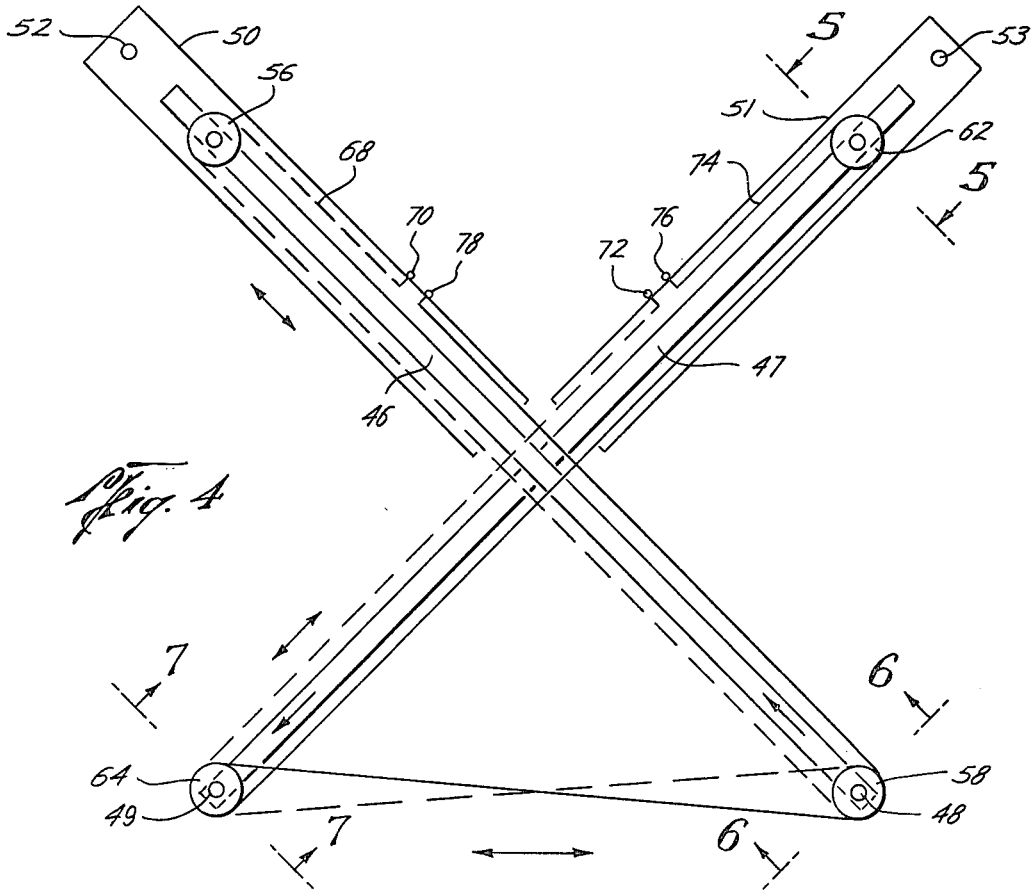
FIG. 4 is a somewhat diagrammatic illustration of the preferred embodiment of the stabilizing apparatus of the present invention as illustrated in FIGS. 1 through 3.
Figure 5:
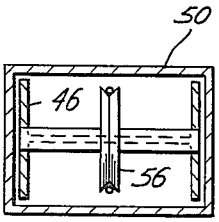
FIG. 5 is an enlarged detail in cross section of the apparatus of FIG. 4, taken along line 5—5 of FIG. 4.
Figure 6:
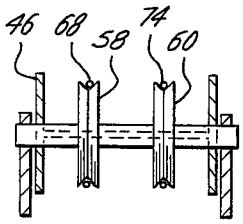
FIG. 6 is an enlarged detail in cross section of the apparatus of FIG. 4, taken along line 6—6 of FIG. 4.
Figure 7:
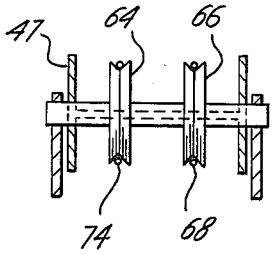
FIG. 7 is an enlarged detail in cross section of the apparatus of FIG. 4, taken along line 7—7 of FIG. 4.

For example, with reference to FIGS. 3 and 4, assume that a force is exerted on the lifting frame 28 or its load (by inertia, gravity, wind or other means) in a direction tending to displace the lifting frame to the left. Since the guides 50 and 51 are fixed relative to the frame 28, sway of the frame and load to the left (as viewed in FIGS. 3 and 4) would require that the first stabilizing rod 46 telescope further into its guide 50 while the second rod 47 must extend further out from its guide 51. For the first stabilizing rod to telescope inwardly and upwardly, the length of cable 68 between the first connection point 70 and upper sheave 56 must be increased. However, because of the reeving arrangement, that segment of the cable 68 cannot be lengthened until slack is provided by a corresponding upward and inward movement of the lower second stabilizing rod 47 relative to its guide 51. This generates a tension force throughout the length of cable 68 which acts simultaneously to restrain movement of both rods 46 and 47, thus preventing or substantially reducing sway of the load. Should a force be exerted tending to cause sway to the right, then the tension force would be generated in the second cable 74.

Figure 8:
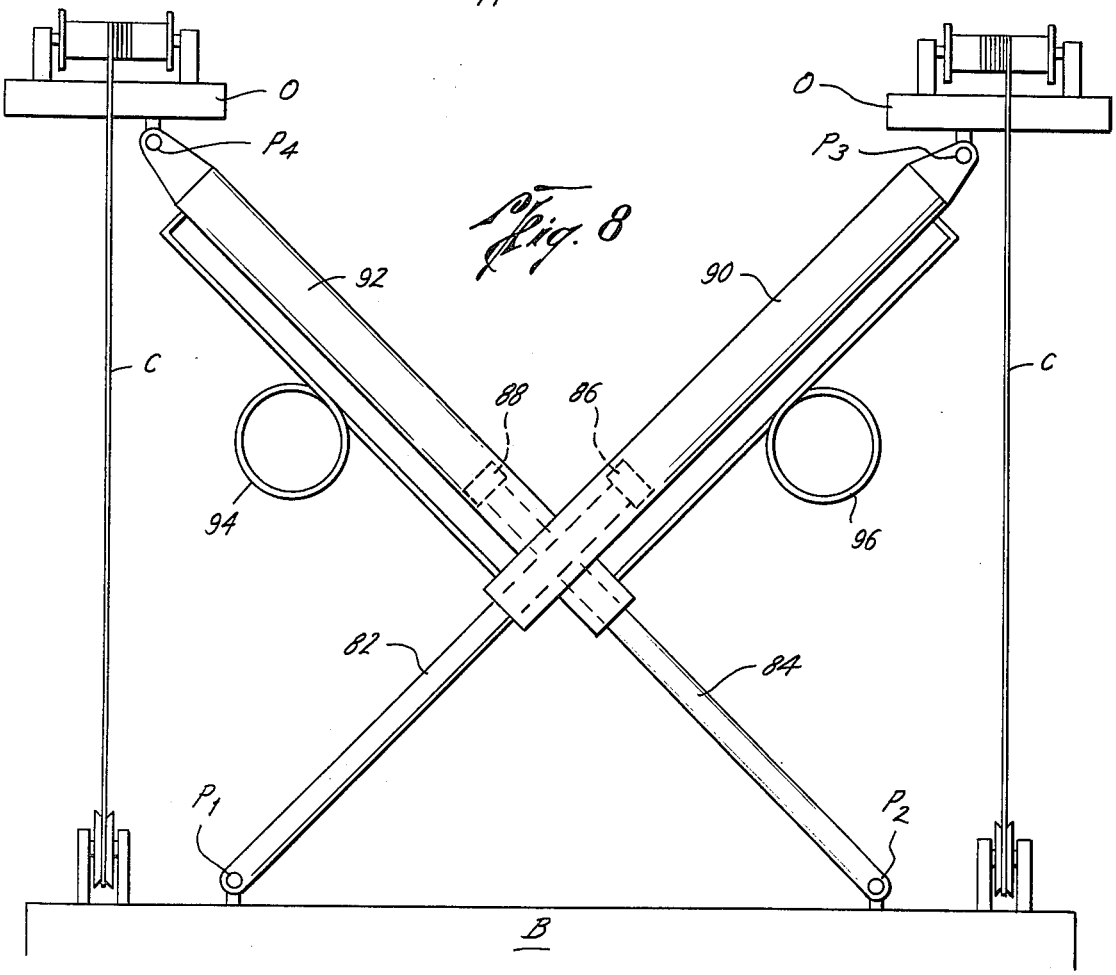
FIG. 8 is a somewhat diagrammatic illustration of an alternate embodiment of the stabilizing device of the present invention utilizing double-acting hydraulic cylinders.

Referring now to FIG. 8, there is shown an alternate embodiment of the stabilizing apparatus of the present invention in which the first and second elongate stabilizing members are piston rods 82 and 84, each pivotally connected at its lower end to a suspended body B, as indicated at pivot points $P_1$ and $P_2$. Body B is suspended from the overhead support O by flexible cables C. If used in connection with the gantry frame as disclosed in connection with the preferred embodiment, then suspended body B would be the lifting frame 28 and the overhead support O would be the trolleys 24 riding on the overhead beams 16.

Pistons 86 and 88 are attached to the upper ends of the first and second piston rods 82 and 84, respectively, and are guided for slidable longitudinal movement within the bores of first and second cylinders 90 and 92, each of which is pivotally connected at its upper end to the overhead support at points $P_3$ and $P_4$. Fluid seals are provided at the lower end of each cylinder about the corresponding piston rod, and the upper end of each cylinder is sealed, so that a pair of double acting hydraulic cylinders are provided.

Force transmitting means are provided comprising hydraulic fluid disposed in the bores of the cylinders 92 and 90 on each side of the pistons 86 and 88, together with hydraulic fluid transmission lines 94 and 96 interconnecting the two cylinders. As shown, the first hydraulic fluid transmission line 94 communicates between the cylinder side of cylinder 92 and the rod side of cylinder 90, while the second line 96 communicates between the cylinder side of cylinder 90 and the rod side of cylinder 92.

With this fluid communication arrangement, the suspended body B may be raised or lowered by the cable C relative to the overhead support O without interference from the stabilizing apparatus. As the body B is raised, each of the pistons 86 and 88 slide inwardly and upwardly in the bores of cylinders 90 and 92 while the rods and cylinders simultaneously pivot to more acute angles to the horizontal. Fluid displaced from the cylinder side of each cylinder is freely admitted to the rod side of the opposing cylinder, so that essentially no forces are generated opposing vertical movement of the body B. Of course, the speed of vertical movement will depend somewhat upon the size of the fluid lines 94 and 96 relative to the amount of fluid displaced.

When the body B is lowered relative to the overhead support, the opposite movement of fluid occurs, with fluid displaced from the piston side of each cylinder being supplied to the cylinder side of the opposing cylinder. Since the two opposing cylinders are symetrically arranged, the amount of fluid displaced from the cylinder side of one cylinder is substantially the same amount required for supply to the rod side of the opposed cylinder, for smooth operation.

Again, however, because of the particular arrangement of the force transmitting means, sway of the suspended body B in a substantially longitudinal direction is prevented. Displacement of the suspended body B to the left, as viewed in FIG. 8, requires that the distance between pivot points $P_2$ and $P_4$ be decreased, while the distance between pivot points $P_1$ and $P_3$ is increased. With respect to the physical apparatus, this requires that the piston 88 move upwardly in the bore of cylinder 92, while the opposed piston 86 must move downwardly in the bore of cylinder 90. Since fluid displaced from the cylinder side of cylinder 92 is transmitted to the rod side of cylinder 90, any pressure exerted on such fluid by the piston 88, as it attempts to move upwardly in the bore of cylinder 92, is automatically transferred to the rod side of piston 86 as it attempts to move downwardly in the bore of cylinder 90, generating opposed forces, which prevent the movement of both pistons 88 and 86. The actual force exerted on the rod side of piston 86 will be smaller than that exerted on the cylinder side of piston 88 by an amount proportional to the cross-sectional area of the piston rod 82. However, in an actual construction, this area is sufficiently small that the two forces may be considered approximately equal and any substantial sway of the suspended body B will be prevented. Any force exerted on the suspended body B tending to sway it to the right as viewed in FIG. 8 will generate corresponding opposed forces between the cylinder side of piston 86 and rod side of piston 88, which will eliminate, or substantially reduce, resultant sway.

The foregoing disclosure and description of the invention is illustrative only and changes may be made in the size, materials, and arrangement of parts, within the scope of the appended claims, without departing from the spirit of the invention.

What is claimed is:

1. A stabilizing apparatus for preventing sway of a body suspended from an overhead support, said apparatus comprising:

a first relatively elongate rigid stabilizing member pivotally connected at one of its ends to one of said body and said overhead support;

first guide means carried by the other of said body and said overhead support and adapted to coact with said first stabilizing member;

a second relatively elongate rigid stabilizing member pivotally connected at one of its ends to one of said body and said overhead support;

second guide means carried by the other of said body and said overhead support and adapted to coact with said second stabilizing member;

said first and second stabilizing members coacting with said first and second guide means to permit said stabilizing members to slide relative to said guide means in a direction parallel to said stabilizing members' longitudinal axis, whereby said body may be raised and lowered relative to said support;

force transmitting means interconnecting said first and second stabilizing members for transmitting a force applied to said body in a direction tending to cause sway to said first and second stabilizing members in opposed directions, whereby said body is stabilized against sway.

2. The apparatus according to claim 1 wherein said force transmitting means comprises at least one flexible connecting element connected to said first and second guide means and reeved about antifriction means associated with said first and second stabilizing members.

3. The apparatus according to claim 2 wherein said antifriction means comprise sheaves and wherein said force transmission means comprise first and second flexible cables;

said first cable being attached at one end thereof to said first guide means, reeved about first and second sheaves near the upper and lower ends, respectively, of said first stabilizing member, reeved about a third sheave near the lower end of said second stabilizing member, and attached at its other end to said second guide means;

said second cable being attached at one end thereof to said second guide means, reeved about fourth and fifth sheaves near the upper and lower ends, respectively, of said second stabilizing member, reeved about a sixth sheave near the lower end of said first stabilizing member and attached at its other end to said second guide means.

4. The apparatus according to claim 1 wherein said first and second stabilizing members and said first and second guide means comprise first and second double-acting hydraulic cylinders, each having a rod side and a cylinder side, and wherein said force transmission means comprise hydraulic fluid and hydraulic fluid transmission lines interconnecting said first and second double-acting cylinders.

5. The apparatus according to claim 4 wherein said fluid communication lines connect the rod side of said first double-acting hydraulic cylinder to the cylinder side of said second double-acting cylinder and the rod side of said second double-acting hydraulic cylinder to the cylinder side of said first double-acting hydraulic cylinder.

6. The apparatus according to any of the preceding claims comprising additionally means for raising and lowering said body relative to said overhead support.

7. A hoisting apparatus comprising a supporting structure having at least one substantially horizontal transverse beam and means for supporting the bean im such horizontal position;

a lifting frame suspended from said beam by flexible suspension means;

load engaging means on said lifting frame for releasably engaging loads to be hoisted by said hoisting apparatus;

means associated with one of said supporting structure and said lifting frame for selectively shortening and lengthening said flexible suspension means to selectively raise and lower said lifting frame;

first and second stabilizing members each pivotally connected at its lower end to said lifting frame;

first and second guide means connected to said supporting structure for guiding the upper ends of said first and second stabilizing members, said guide means permitting both longitudinal and pivotal movement of said upper ends of said first and second stabilizing members relative to said beam;

force transmitting means interconnecting said first and second stabilizing members for transmitting a force applied to said lifting frame in a direction tending to cause sway of said frame to said first and second stabilizing members in opposed directions, whereby said lifting frame is stabilized against sway.

8. The hoisting appratus according to claim 7 comprising additionally means associated with said supporting structure for moving said lifting frame in a generally horizontal direction.

9. The apparatus according to claim 8 wherein said means for moving said lifting frame comprise powered wheels for moving said supporting structure.

10. The appratus according to claim 8 wherein said means for moving said lifting frame comprise a trolley mounted on said beam for movement parallel to the longitudinal axis of said beam and wherein said flexible suspension means are carried by said trolley.

11. The apparatus according to claim 7 wherein said supporting structure includes two substantially horizontal transverse beams.

12. The apparatus according to claim 7 wherein said force transmitting means comprises at least one flexible connecting element connected to said first and second guide means and reeved about anti-friction means associated with said first and second stabilizing members.

13. The apparatus according to claim 7 wherein said anti-friction means comprise sheaves and wherein said force transmission means comprise first and second flexible cables;

said first cable being attached at one end thereof to said first guide means, reeved about first and second sheave near the upper and lower ends, respectively, of said first stabilizing member, reeved about a third sheave near the lower end of said second stabilizing member, and attached at its other end to said second guide means;

said second cable being attached at one end thereof to said second guide means, reeved about fourth and fifth sheaves near the upper and lower ends, respectively, of said second stabilizing member, reeved about a sixth sheave near the lower end of said first stabilizing member and attached at its other end to said second guide means.

14. The apparatus according to claim 7 wherein said first and second stabilizing members and said first and second guide means comprise first and second double-acting hydraulic cylinders, each having a rod side and a cylinder side, and wherein said force transmission means comprise hydraulic fluid and hydraulic fluid transmission lines interconnecting said first and second double-acting cylinders.

15. The apparatus according to claim 7 wherein said fluid communication lines connect the rod side of said first double-acting hydraulic cylinder to the cylinder side of said second double-acting cylinder and the rod side of said second double-acting hydraulic cylinder to the cylinder side of said first double-acting hydraulic cylinder.

16. An apparatus for stabilizing a body suspended from an overhead support, said apparatus comprising:

first and second relatively elongate rigid stabilizing members, each pivotally connected at its lower end to said body;

first and second guide means carried by said overhead stabilizing members, such guide means permitting both longitudinal and pivotal movement of said upper ends of said stabilizing members relative to said overhead support;

said first and second stabilizing members extending between said guide means and said body at approximately equal opposed acute angles with respect to the horizontal;

the longitudinal axes of said first and second guide means lying in approximately parallel vertical planes;

force transmitting means interconnecting said first and second stabilizing members for transmitting a force tending to cause sway of said body in a direction generally parallel to said vertical planes to said first and second stabilizing members in opposed directions, whereby said body is stabilized against sway.

17. The apparatus according to claim 16 wherein said overhead support is a gantry and said body is a lifting frame adapted to releasably engage loads being handled by said gantry frame.

18. The apparatus according to claim 16 wherein said first and second stabilizing members comprise elongated rods provided with anti-friction means at each of their upper and lower ends and said force transmission means comprise at least one flexible connecting element reeved about said anti-friction means and attached to each of said first and second guide means.

19. The apparatus according to claim 16 wherein said first and second stabilizing members and said first and second guide means comprise first and second double-acting hydraulic cylinders, each having a rod side and a cylinder side, and wherein force transmission means comprise hydraulic fluid and hydraulic fluid transmission lines interconnecting said first and second double-acting cylinders.

* * * * *